US009561574B2

(12) United States Patent
Wisenbaker

(10) Patent No.: US 9,561,574 B2
(45) Date of Patent: Feb. 7, 2017

(54) WHEELED MOUNT FOR HANDHELD TOOLS

(71) Applicant: Brian Lynn Wisenbaker, Bryan, TX (US)

(72) Inventor: Brian Lynn Wisenbaker, Bryan, TX (US)

( * ) Notice: Subject to any disclaimer, the term of this patent is extended or adjusted under 35 U.S.C. 154(b) by 0 days.

(21) Appl. No.: 14/186,423

(22) Filed: Feb. 21, 2014

(65) Prior Publication Data

US 2015/0239088 A1 Aug. 27, 2015

(51) Int. Cl.

| | |
|---|---|
| ***B24B 23/00*** | (2006.01) |
| ***B24B 23/02*** | (2006.01) |
| ***B25H 1/00*** | (2006.01) |
| ***B24B 27/08*** | (2006.01) |
| ***B25H 1/10*** | (2006.01) |

(52) U.S. Cl.

CPC ..... *B24B 23/005* (2013.01); *B24B 23/028* (2013.01); *B25H 1/0078* (2013.01); *B25H 1/10* (2013.01); *B24B 27/08* (2013.01)

(58) Field of Classification Search

CPC ..... B24B 27/08; B24B 23/005

USPC ..... 451/344, 350, 353; 125/13.01, 13.03

See application file for complete search history.

(56) References Cited

U.S. PATENT DOCUMENTS

| | | | | |
|---|---|---|---|---|
| 7,905,223 | B2 * | 3/2011 | von Siegroth et al. | 125/13.01 |
| 8,347,872 | B2 * | 1/2013 | Gobright, IV | 125/13.03 |
| 2007/0228805 | A1 * | 10/2007 | Due | 299/37.1 |
| 2008/0171499 | A1 * | 7/2008 | Stoll | 451/350 |
| 2010/0059949 | A1 * | 3/2010 | Kennard | 280/47.21 |

* cited by examiner

*Primary Examiner* — Monica Carter
*Assistant Examiner* — Lauren Beronja
(74) *Attorney, Agent, or Firm* — John Alumit

(57) ABSTRACT

A wheeled mount for handheld tools with a frame having an upper and lower region, a pair of handles attached to and projecting away from the upper frame region, an 5 axle attached to the lower frame region, a pair of wheels in contact with a generally horizontal surface and further fixed to the axle and a handheld tool positioned on or within and secured to the lower frame to position the attachment of the handheld tool in contact with the generally horizontal surface thereby creating a stable three point contact for the wheeled mount for handheld tools. An operator can safely operate and move the wheeled 10 mount for handheld tools in a manner similar to using a hand dolly.

4 Claims, 7 Drawing Sheets

WHEELED MOUNT FOR HANDHELD TOOLS

BACKGROUND

This invention relates generally to the field of handheld tools and more specifically to mounts for holding portable grinders, needle gun scalers or other handheld tools safely against a generally horizontal surface such as a deck or floor. In particular, the wheeled mount for handheld tools is configured to allow a user to stand substantially upright while operating a handheld tool located near a generally horizontal surface, like a deck or floor, in a safe manner.

Portable grinders, also known as an angle, side or disc grinders, and needle scalers are handheld tools used for cutting, grinding, polishing and removing rust or other scale like material from a surface. These handheld tools are typically powered electrically, by onboard internal combustion engines or using compressed air, although electricity or a compressed gas is more common. In the case of a portable grinder, the power source drives a geared head at a right angle on which is mounted an attachment such as an abrasive disc, cut-off disc, grinding stone, sanding disc, wire brush wheel, buffing/polishing pad or similarly featured rotating apparatus. In the instance of a needle gun scaler, a bundle of very fine chisels or "needles" is moved back and forth along its longitudinal axis by a piston, typically under pneumatic power, although electric motor or internal combustion engine drives are known. The needle gun scaler forces the needle bundle against a work surface, such as a floor or deck at variable speeds up to about 5,000 times per minute.

Typical portable hand tools, including grinders and needle gun scalers have a trigger in a barrel handle distal to the power head housing. Usually a series of threaded holes formed in the power head housing allow a threaded handle to be screwed into the power head, giving operators a two handed grip on the portable hand tool. With the typical needle gun scaler, operators typically place both hands on the handle barrel. Controlling the movement of a typical handheld tool with a two handed grip is relatively simple when the operator is not required to stoop, bend or kneel. However, two handed control of portable power tools, such as grinders or needle gun scalers operated near a generally horizontal surface is challenging and dangerous, because operators must stoop, bend at the waist, kneel or lay on the horizontal surface. Without a proper stance and secure two handed grip on the portable hand tool, operators can lose control of the handheld tool causing serious injuries. Even with a proper two handed grip, keeping an abrasive disc, cut-off disc, grinding stone, sanding disc, wire brush wheel, buffing/polishing pad, chisel or bundle of needles at a desirable angle to and in contact with a generally horizontal floor level surface is difficult. As such, operators can be easily injured if the proper angle is not maintained or if the operator becomes fatigued, which occurs easily when squatting, sitting or laying near the portable hand tool.

Therefore there is a need for a new and novel apparatus for maintaining control over a handheld tool, like a grinder or needle gun scaler, by keeping the handheld tool in the proper orientation to a generally horizontal surface while simultaneously allowing an operator to stand upright and away from the handheld tool, including providing the advantage of being easy to manufacture and operate.

SUMMARY

Disclosed is an apparatus for driving an angle grinder having a spindle assembly. The apparatus includes a frame having an upper region and a lower region. A handle assembly attached to the top of the upper region at an end of the upper region opposite the lower region projects away from the upper region. In a preferred embodiment, the handle assembly includes two handles that extend laterally away from the upper region. An axle is included at the bottom of the upper region, near the intersection of the upper region and the lower region, and a pair of wheels is fixed to the axle such that the upper region and the lower region cantilever with respect to the wheels.

An angle grinder is secured against the lower region at an end of the lower region opposite from the pair of wheels. Power is provided to the angle grinder by a cord extending from the angle grinder to a controller on the upper region, and power to the grinding tool is governed by a controller adjacent the handle assembly. The controller may include a handle lever that allows a user to variably govern the speed of the angle grinder while maintaining a grip on the handle.

The spindle assembly of the angle grinder is preferably preserved at a substantially ninety degree angle relative to the lower region of the frame. In order to preserve the angle grinder in position, the angle grinder is anchored to the lower region by a bolt passing through a mount and into a threaded hole formed in the angle grinder. In this manner, an off-the-shelf angle grinder may be used, one or more bolts being inserted into the threaded bore for the angle grinder handle. While the primary anticipated purpose of the apparatus is for grinding down weld remnants, such as those caused by removal of dog welds aboard a ship or ocean platform, the apparatus may be employed for a variety of uses. Depending on the use, the angle grinder may include an attachment selected from a group consisting of an abrasive disc, cut-off disc, grinding stone, sanding disc, wire brush wheel, buffing pad, polishing pad, at least one chisel or a bundle of needles or a combination thereof.

Due to the risk of material being ejected from the grinding area, including weld debris, or even small portions of a grinding attachment, the apparatus may include a guard affixed to the lower region partially circumferentially surrounding the attachment. To promote efficiency and ease of use, the apparatus may include a cable mount for holding a length of power cord on the upper region. In one embodiment, the lower region is constructed to accept an off-the-shelf angle grinder, which may be held in place as mentioned above by the threaded handle bores of the angle grinder.

In another embodiment, the apparatus may include a secondary mount for holding a pneumatic needle scaler. Preferably the secondary mount is articulating and may be affixed to the primary mount which holds the angle grinder. In one embodiment, the secondary mount may include a plate with U-bolts for holding a needle scaler rigid with respect to the apparatus. Preferably, the pneumatic needle scaler is in fluid communication with an air compression source that connects through the handle assembly. This may include a pneumatic quick-release incorporated into the handle assembly.

To prevent damage to the pneumatic needle scaler or user injury, a gas pressure relief valve is preferably included along the air line between the handle assembly and the pneumatic needle scaler, which are in fluid communication. In one embodiment, the gas pressure relief valve may be incorporated into the upper region of the frame of the assembly. In another embodiment a pneumatic controller may be adjacent to or incorporated into the handle assembly for governing the speed of the pneumatic needle scaler in a manner similar to the angle grinder.

To promote safe operation, the apparatus may include a switched outlet for cutting power to the angle grinder mounted to the upper region near the handle assembly, and likewise the apparatus may include a switched manifold also mounted to the upper region near the handle assembly.

To use the apparatus, which may be characterized as a vehicle for driving an angle grinder, a user grasps the handles affixed to the upper region of the two-wheeled frame, and directs the angle grinder affixed to the lower region of the frame toward an area to be smoothed. The frame is shaped such that the angle grinder and handles cantilever, pivoting at the wheels. In this manner a user may apply even and well-guided pressure of a grinding attachment against the area to be smoothed. After connecting the vehicle to a power source, power to the angle grinder is governed by the handles. As a user lifts up on the handles, the angle grinder, which is affixed to the lower region near the spindle assembly of the angle grinder, is brought to bear against an area needing smoothing. When not in use, the power cord may be wrapped on a mount on the upper region of the vehicle and the vehicle rolled into an appropriate storage area.

REFERENCE NUMBERS

Figure 1:
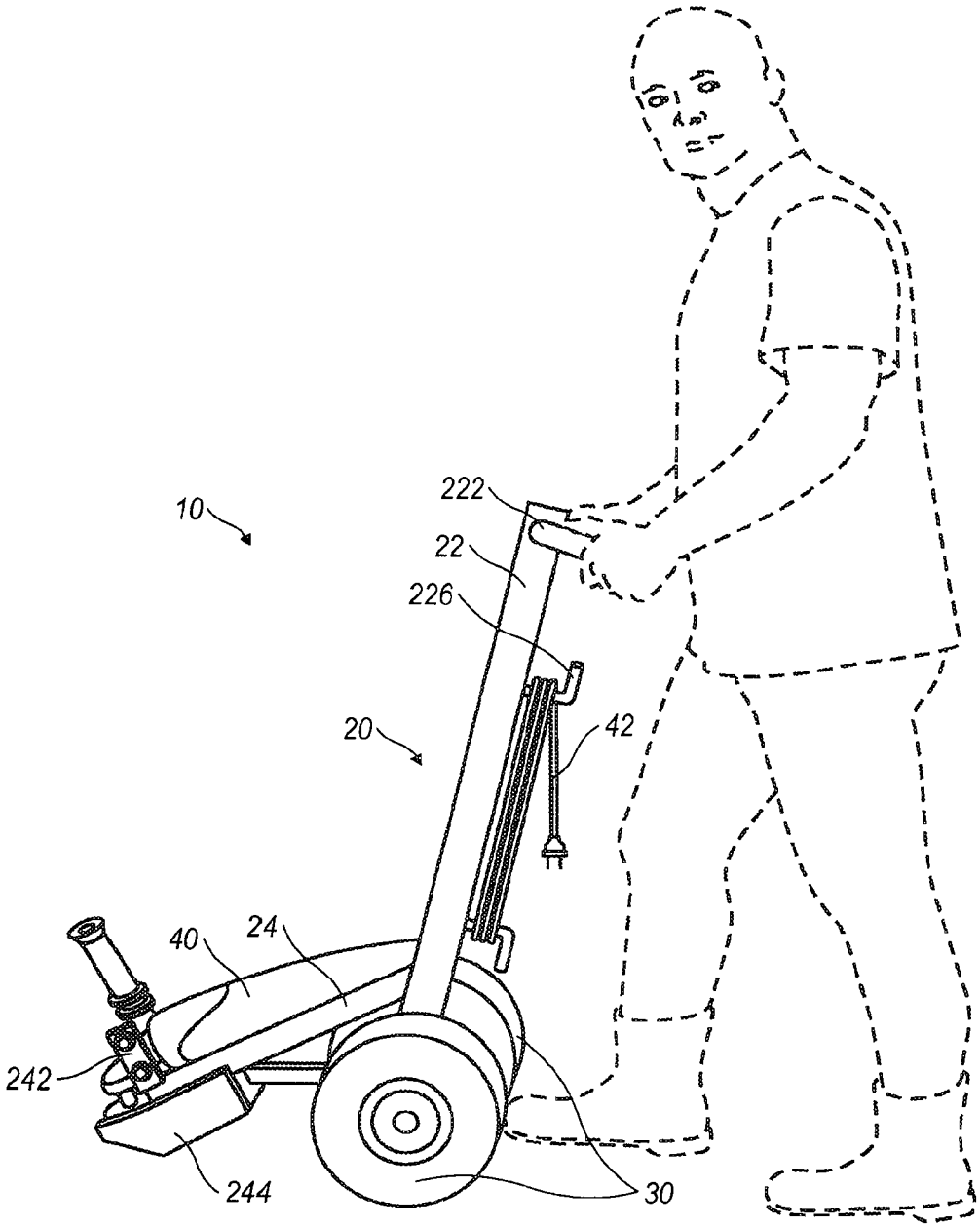
FIG. 1 depicts an elevation view of the wheeled mount for handheld tools, where the handheld tool is a grinder.
Figure 2:
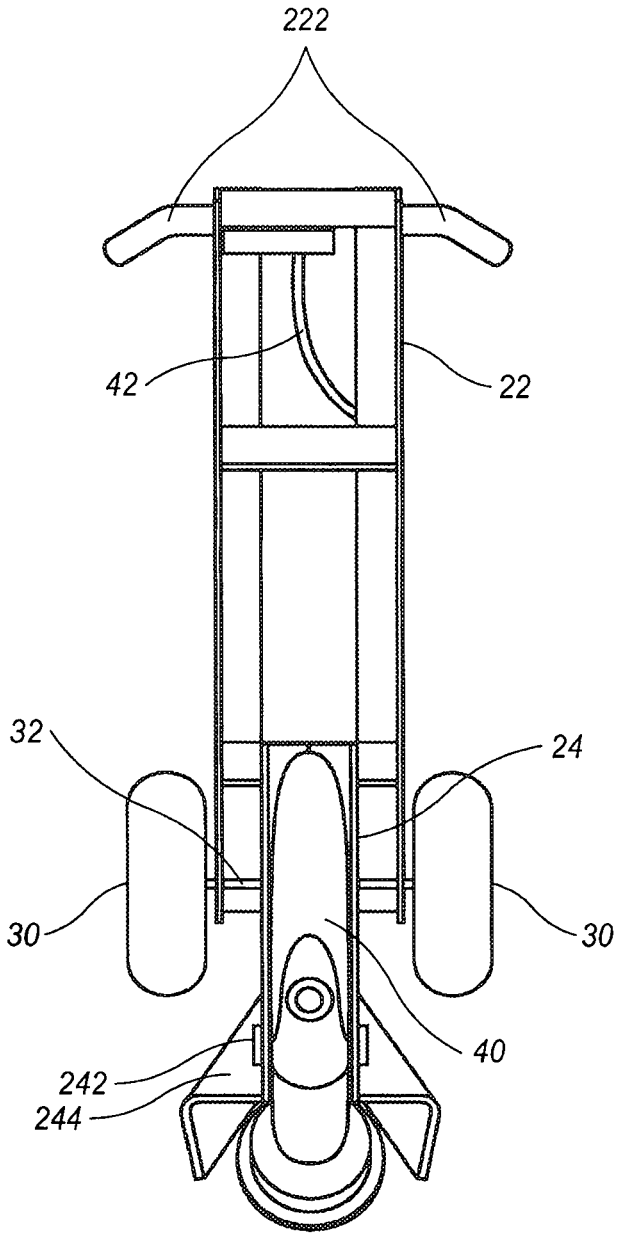
FIG. 2 depicts a front view of the wheeled mount for handheld tools, wherein the handheld tool is a grinder.
Figure 3:
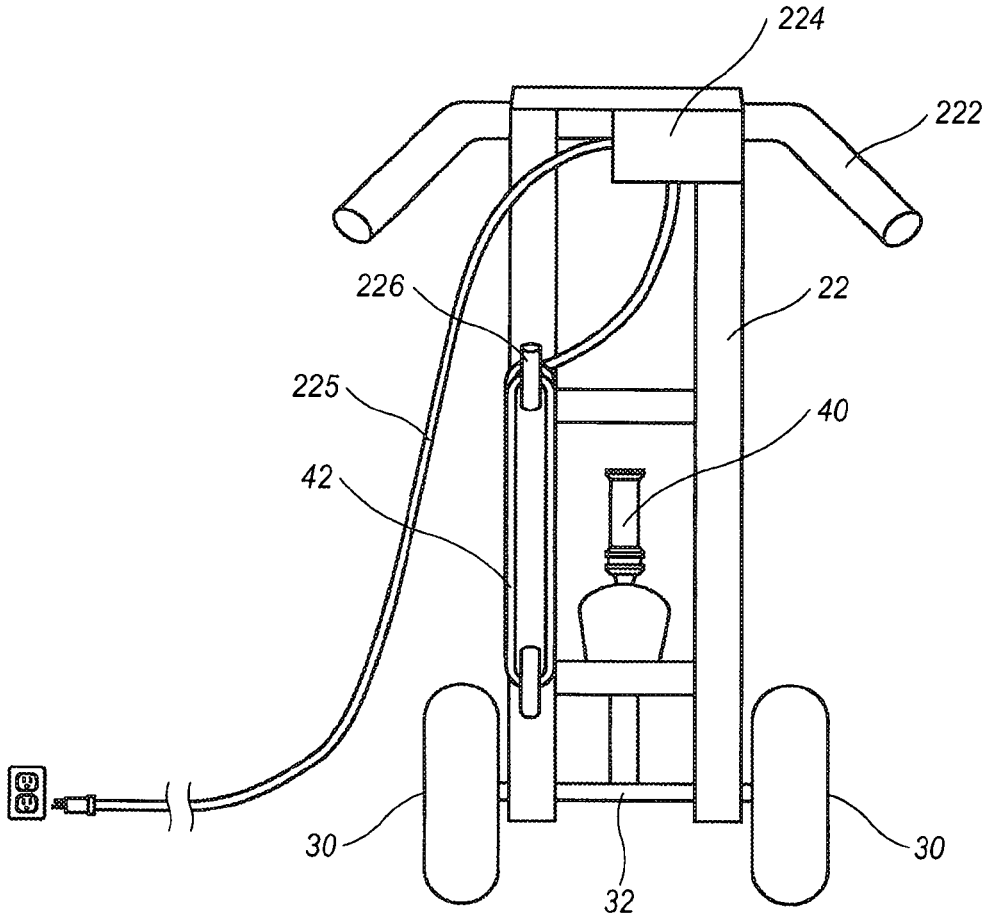
FIG. 3 depicts a back view of the wheeled mount for handheld tools, where the handheld tool is a grinder.

10. Wheeled Mount for Handheld Tools
20. Frame
22. Upper Frame
24. Lower Frame
30. Wheels
32. Axle
40. Handheld Tool
41. Pneumatically Powered Handheld Tool
42. Cord
43. Air Hose
44. Angle and Orient Attachment
45. Plate
221. Lever
222. Handle
223. Pneumatic Manifold
224. Switched Outlet
225. Power Cord
226. Holder
227. Air Supply Hose
242. Handheld Tool Mount
244. Guard
246. Bolt
248. Secondary Mount
250. Pneumatic Air Hose
252. Pneumatic On/Off Valve
452. Clamps
454. Angle Grinder
456. Needle Scaler

DESCRIPTION

As required, detailed embodiments of the present invention are disclosed herein; however, it is to be understood that the disclosed embodiments are merely exemplary of the invention that may be embodied in various and alternative forms. The apparatus shown in the figures is not necessarily to scale; some features may be exaggerated to show details of particular components. Therefore, specific structural and functional details disclosed herein are not to be interpreted as limiting, but merely as a basis of the claims and as a representative basis for teaching one skilled in the art to variously employ the present invention.

Certain terminology will be used in the following description for convenience and reference only and not for purposes of limitation. For example, the words "rightwardly," "leftwardly," "upwardly" and "downwardly" will refer to directions in the drawings to which reference is made. The words "inwardly" and "outwardly" refer to directions toward and away from, respectively, the geometric center of the structure being referred to. This terminology includes these words, specifically mentioned derivatives thereof, and words of similar import. Furthermore, elements may be recited as being "coupled;" this terminology's use anticipates elements being connected together in such a way that there may be other components interstitially located between the specified elements and that the elements may be connected in fixed or movable relation one to the other. Certain components may be described as being adjacent to one another. In these instances, it is expected that such a relationship so described shall be interpreted to mean that the components are located proximate to one another, but not necessarily in contact with each other. Normally there will be an absence of other components positioned there between, but this is not a requirement. Still further, some structural relationships or orientations may be designated with the word "substantially." In those cases, it is meant that the relationship or orientation is as described, with allowances for variations that do not affect the cooperation of the so described component or components.

Referring to FIG. 1, the wheeled mount for handheld tools 10 includes a frame 20 having an upper frame 22 and a lower frame 24, a pair of handles 222 attached to and projecting away from the upper frame 22, an axle 32 (not shown) attached to the lower frame 24, a pair of wheels 30 fixed the axle 32, and either an electrically powered handheld tool 40, a pneumatically powered handheld tool 41 (not shown), or both securely attached to lower frame 24. In a preferred embodiment an operator can adjust handles 222 up or down to best fit the operator. In yet another embodiment, upper frame 22 can be extended or collapsed to alter its length. In yet another embodiment, upper frame 22 is foldable for ease of stowage and transport. Likewise, in another embodiment, lower frame 24 is foldable for ease of stowage and transport.

In one embodiment, cord 42 from the electrically powered handheld tool 40 is electrically connected to a switched outlet 224 (not shown) attached to upper frame 22. In another embodiment, the switch of the switched outlet 224 may be a lever 223 (see FIG. 6) located adjacent handle 222 so an operators can squeeze it to energize the circuit and provide variable power to the handheld tool 40. As depicted in FIGS. 1 through 4, the electrically powered handheld tool 40 is an angle grinder. In a preferred embodiment, switched outlet 224 is located close to and below handle 222 for ease of operation. In a preferred embodiment, a dead man switch is electrically connected between switched outlet 224 and handheld tool 40. A power cord 225 electrically connects switched outlet 224 to an electrical outlet within reach of power cord 225. Holder 226 is attached to frame 20 and in a preferred embodiment, upper frame 22. In a preferred embodiment, holder 226 is mounted below switched outlet 224. The holder 226 is preferably configured to receive and hold excess cord 42 and/or power cord 225.

Figure 5:
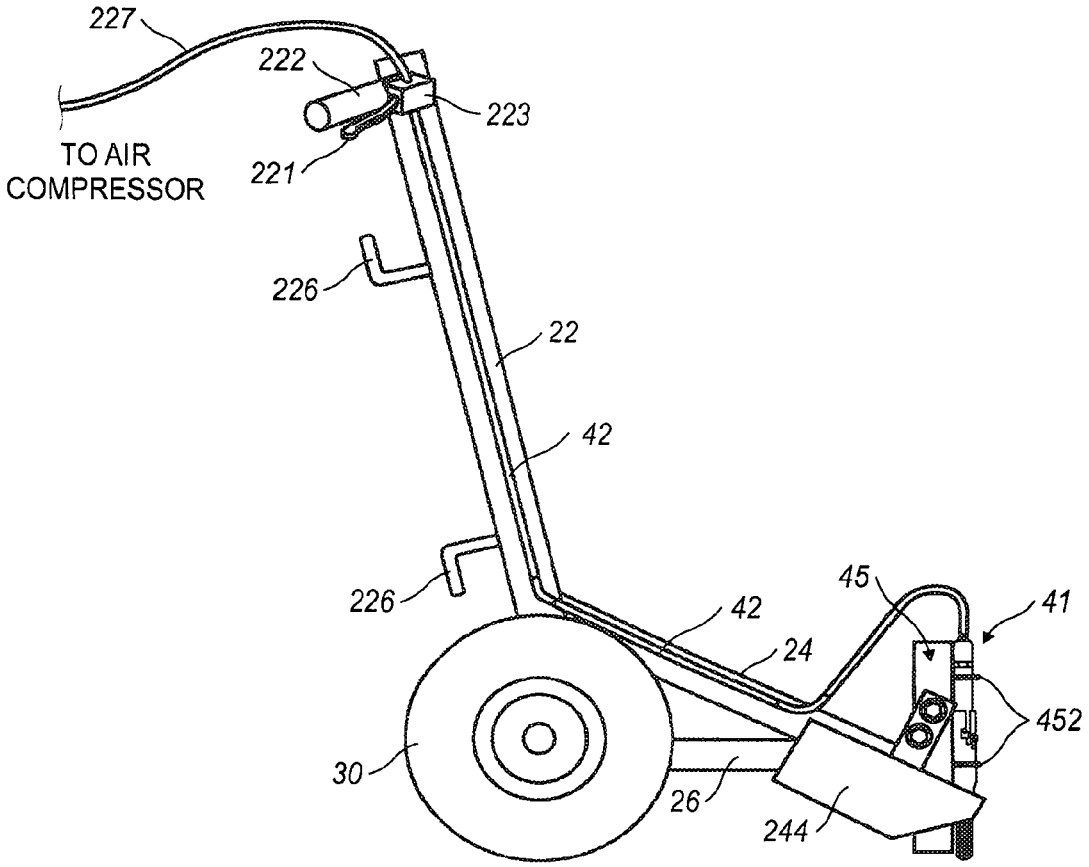
FIG. 5 depicts an elevation view of a wheeled mount for handheld tools where the hand held tool is a needle gun scaler.

FIG. 5 depicts another embodiment of the wheeled mount for handheld tool 10, in which an air hose 43 from a pneumatically powered handheld tool 41, is fluidly connected to a switched pneumatic manifold 223 attached to upper frame 22. In a preferred embodiment, switched pneumatic manifold 223 is located close to and below handle 222 for ease of operation by a lever 221 (see FIG. 5). In a preferred embodiment, a dead man switch is connected between switched pneumatic manifold 223 and pneumatic powered handheld tool 41. A supply air hose 227 fluidly connects switched pneumatic manifold 223 to an air supply within reach of supply air hose 227. Holder 226 is attached to frame 20 and in a preferred embodiment, upper frame 22. In a preferred embodiment, holder 226 is mounted below switched pneumatic manifold 223. The holder 226 is configured to receive and hold excess hose 42 and/or supply air hose 227.

A pair of wheels 30 are rotatably fixed to an axle 32 which in turn is fixed to a bottom region of upper frame 22. See FIGS. 1, 2 and 3. Upper frame 22 and lower frame 24 are preferably connected to each other at an angle of approximately 135 to 145 degrees. In a preferred embodiment, upper frame 22 is angled approximately 5 degrees off a vertical axis and lower frame 24 is angled toward a generally horizontal surface such that the angle between upper and lower frames 22 and 24 is approximately 142 degrees.

Figure 4:
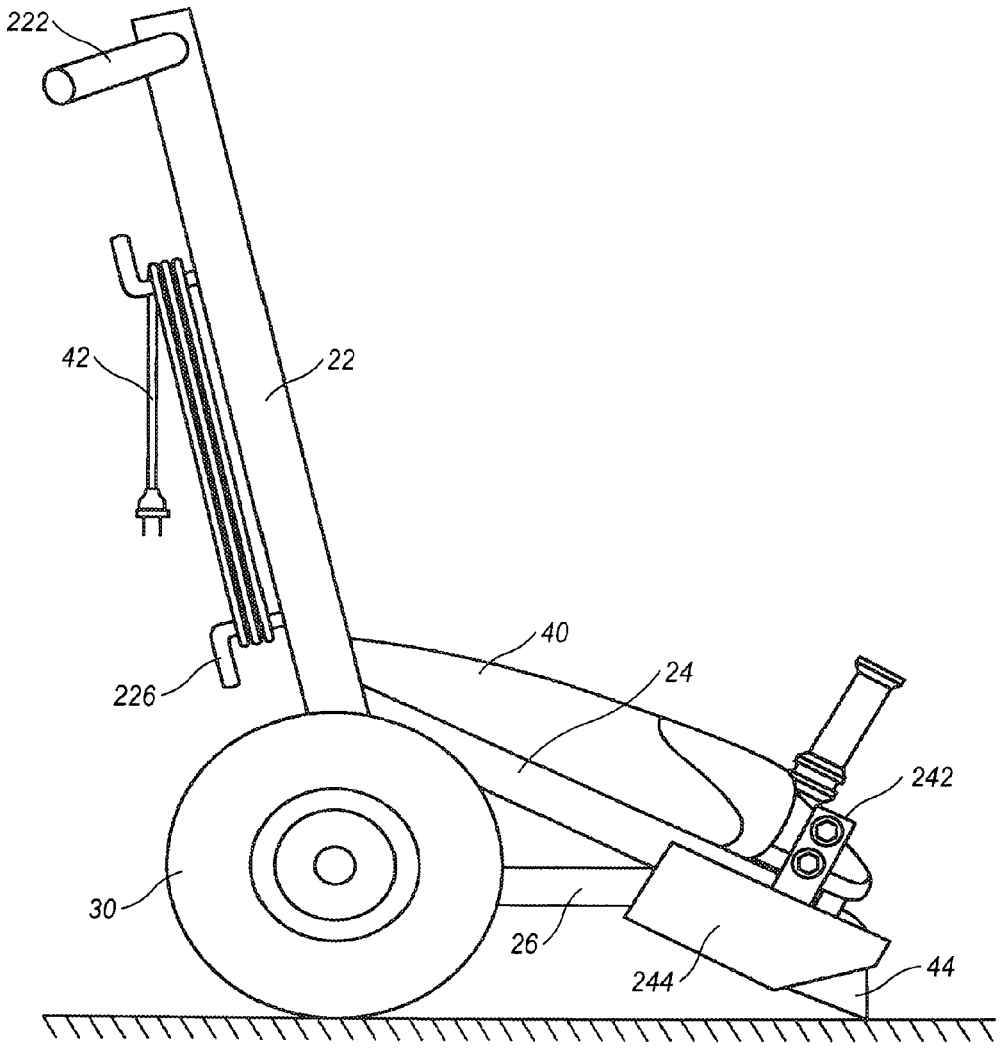
FIG. 4 depicts a detailed elevation view of the wheeled mount for handheld tools, wherein the handheld tool is a grinder.

A handheld tool mount 242 is fixed to lower frame 24 away from the pair of wheels 30. Handheld tool mount 242 is connected to an electrically powered handheld tool 40, pneumatically powered handheld tool 41 or a plate 45. See FIGS. 4 and 5. As depicted in FIG. 4, an electrically powered handheld tool 40, in the form of a grinder, is securely mounted by at least two bolts passing through handheld tool mount 242 and into bolt holes formed in the head of electrically powered handheld tool 40. It is contemplated that the same securing arrangement is used for a pneumatically powered handheld tool 41, such as a pneumatically powered grinder. The electrically powered handheld tool 40 is securely positioned within and in contact with lower frame 24 to angle and orient attachment 44 to the appropriate angle of approximately 45 to 50 degrees from the generally horizontal surface. See FIGS. 2 and 3. It is contemplated that the same angles and orientation can be used for a pneumatically powered handheld tool 41, such a pneumatically powered grinder.

As depicted in FIG. 5, a plate 45 is fixed to handheld tool mount 242 and positioned in a generally vertical position by threaded bolts. See FIG. 5. Either an electrically powered handheld tool 40 or a pneumatically powered handheld tool 41 is fixed to plate 45 by clamps 452. See FIG. 5. This arrangement is especially useful for those handheld tools that must be mounted vertically to position its attachment 44 in a particular orientation. For example, with a needle gun scaler, the attachment 44 is a bundle of needles that require a perpendicular orientation to the generally horizontal surface. See FIG. 5. The same could be said for a handheld tool with an attachment 44 that is a buffing pad.

In another embodiment of the invention, attachment 44 and the pair of wheels 30 form a stable three point contact with the generally horizontal surface. Attachment 44 can be one attachment selected from the group consisting of an abrasive disc, cut-off disc, grinding stone, sanding disc, wire brush wheel, buffing pad, polishing pad, at least one chisel or a bundle of needles. In a preferred embodiment, the pair of wheels 30 is about 10" to 17" in diameter and the distance between the outer surfaces of wheels 30 is approximately 12" to 18." In a preferred embodiment, a lower frame brace 26 is connected between upper frame 22 and lower frame 24 beneath lower frame 24. Lower frame brace 26 stiffens the connection between upper and lower frames 22 and 24.

A guard 244 extends downward from lower frame 24 to just above generally horizontal surface. Guard 244 can be a "U" shaped material wherein the bottom of the "U" is facing axle 32. In this configuration any debris dislodged by attachment 44 from generally horizontal surface will be deflected away from an operator. In another embodiment, guard 244 is angular in shape but with at least one opening located away from axle 32.

Figure 6:
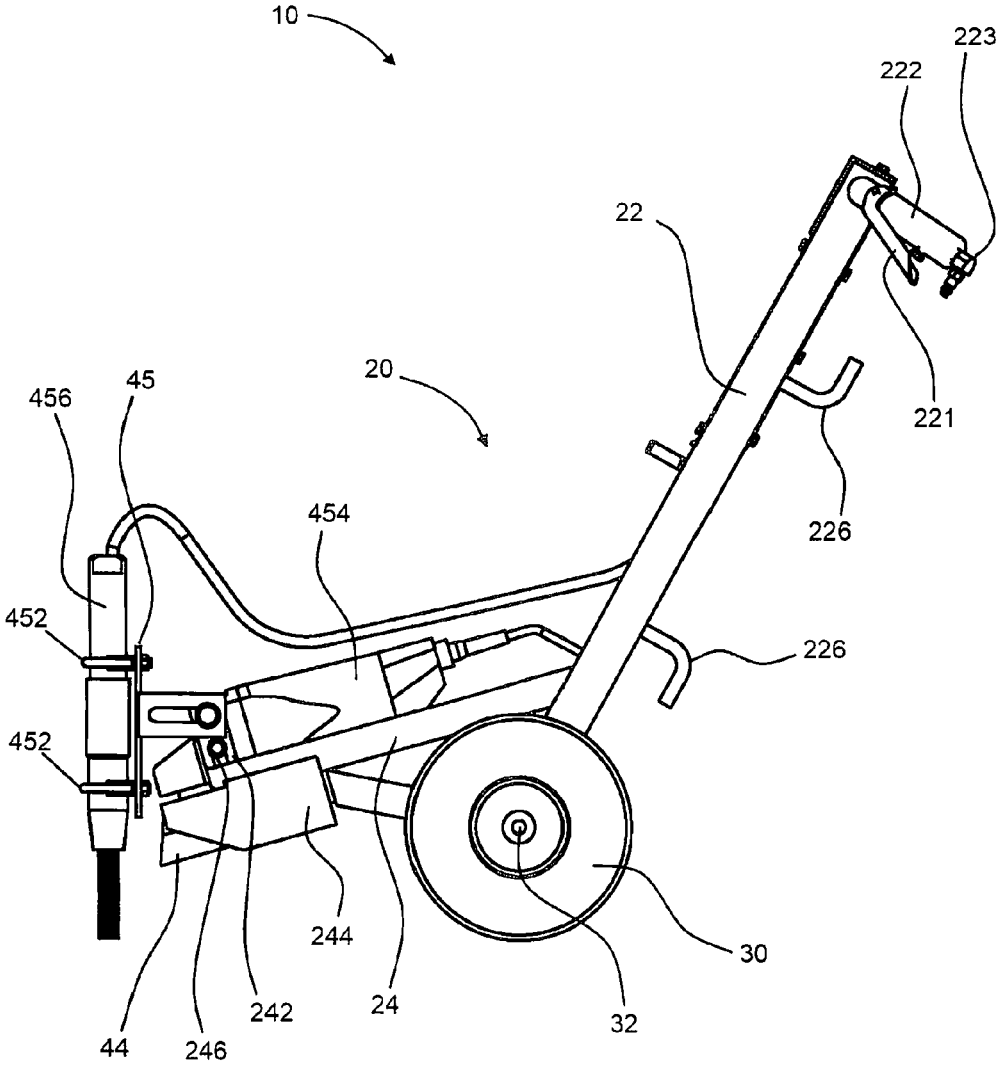
FIG. 6 depicts an elevation view of a wheeled mount for handheld tools including both an angle grinder and a needle scaler.

Referring to FIG. 6, the wheeled mount for handheld tools 10 comprises a preferred embodiment including an angle grinder 454 and needle scaler 456. In this embodiment, the angle grinder 454 is installed on the lower frame 24, and anchored in place using handheld tool mount 242. As shown the handheld tool mount 242 includes a bolt 246 adapted to engage the threaded bore (not shown) used for anchoring a handle to the angle grinder 454. The needle scaler 456 is installed on a secondary mount 248, which preferably affixes to the tool mount 242. The secondary mount 248 may include a plate 45 to which the needle scaler 456 is affixed using clamps 452, which may be U-bolts.

Figure 7:
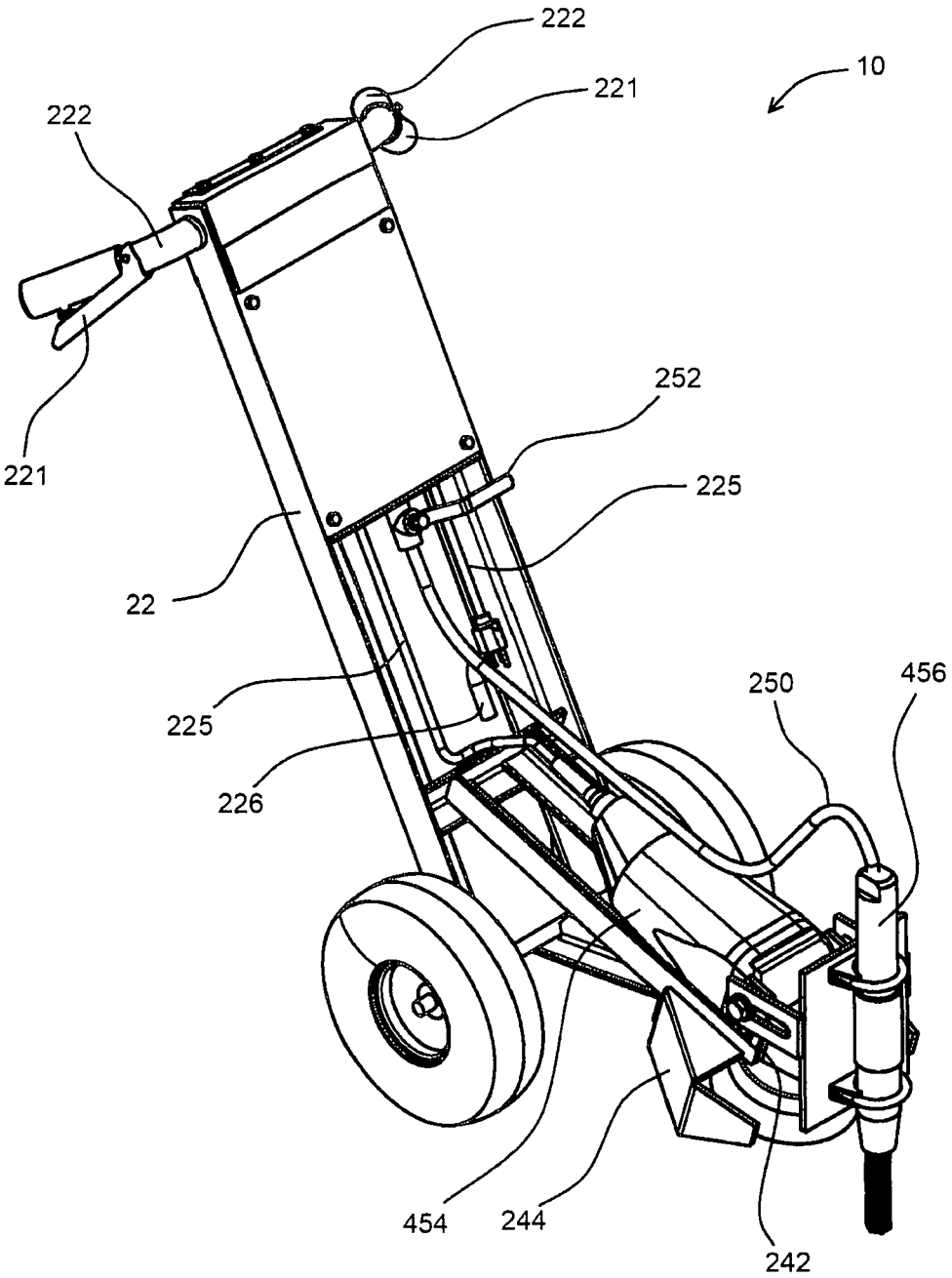
FIG. 7 depicts a perspective view of a wheeled mount for handheld tools including both an angle grinder and a needle scaler.

Referring to FIG. 7 the wheeled mount for handheld tools 10 is shown in perspective view. In this view, the connections for powering the angle grinder 454 and needle scaler 456 are shown. The angle grinder 454 is affixed to the handheld tool mount 242. Power for the angle grinder 454 is provided by a power cord 225, in this embodiment extending from the angle grinder 454 to a controller (not shown) associated with a handle 222 lever 221. From the controller, another power cord 225 is wrapped around the holder 226, and can be unwound and plugged in for operation. For powering the needle scaler 456, a pneumatic air hose 250 leads to the handle 222 where control of the needle scaler 456 is governed. A pneumatic on/off valve 252 may be provided, including a pressure relief capability, for stopping the flow of compressed air to the needle scaler 456.

It is contemplated that the present invention can be constructed from any ferrous or non-ferrous metals, carbon fiber, fiberglass, and/or wood material of sufficient dimensions to securely hold an electrically powered handheld tool 40 or pneumatically powered handheld tool 41 against lower frame 24 when attachment 44 is in contact against a generally horizontal surface. The material used to construct the wheeled mount for handheld tools 10 can be solid, hollow, and/or having cross sections that are circular, oval, polygonal, arcuate and/or angled, so long as the construction is stiff and sturdy. The pair of wheels 30 can be inflatable or solid, and with or without treads.

To use the wheeled mount for handheld tools 10, the operator removes any threaded handles from the electrically or pneumatically powered handheld tool 40 or 41. The handle of electrically or pneumatically powered handheld tool 40 or 41 is positioned on or within and in further contact with lower frame 24. The operator passes threaded bolts through the mount 242 and into the threaded holes of the electrically or pneumatically powered handheld tool 40 or 41 to securely mount it to wheeled mount for handheld tools 10. In 15 another embodiment, the operator attaches a plate 45 to mount 242 with threaded bolts and thereafter attaches a electrically or pneumatically powered handheld tool 40 or 41 to plate 45 with threaded clamps 452.

In a preferred embodiment, the operator ensures that the switched outlet 224 is deenergized and then connects power cord 42 to switched outlet 224. Thereafter, the operator connects power cord 226 or air hose 227 into an appropriate power source. The operator then configures the trigger on the electrically or pneumatically powered handheld tool 40 or 41 to remain on so that operation of the electrically or pneumatically powered handheld tool 40 or 41 is controlled from the either the switched outlet 224, switched pneumatic manifold 223 or deadman switch. With both hands firmly grasping the handles 222, the operator energizes the switched outlet 224 or switched pneumatic manifold 223 with at least one finger. The electrically or pneumatically powered handheld tool 40 or 41 can be moved by the operator pushing or pulling the handles 222. The operator can also increase pressure on the attachment 44 by rocking the handles 222 forward toward the generally horizontal surface. In short, an operator can safely operate and move the wheeled mount for handheld tools 10 and the mounted handheld tool in a manner similar to using a hand dolly.

It will be understood that certain features and sub-combinations are of utility and 10 may be employed without any reference to other features and sub-combinations. This is contemplated by and is within the scope of the claims. Since many possible embodiments of the invention may be made without departing from the scope thereof, it is to be understood that all matters herein set forth or shown in the accompanying drawings are to be interpreted as illustrative and not in a limiting sense.

What is claimed is:

1. An apparatus for driving an angle grinder having a spindle assembly comprising:

a frame having an upper region and a lower region;

a handle assembly attached to the upper region at an end of the upper region distal from the lower region, the handle assembly projecting away from the upper region;

an axle near the intersection of the upper region and the lower region;

a pair of wheels fixed to the axle such that the upper region and the lower region cantilever with respect to the wheels; and an angle grinder secured against the lower region at an end of the lower region distal from the pair of wheels, wherein power to the grinding tool is governed by a controller adjacent the handle assembly and wherein the spindle assembly is preserved at a substantially ninety degree angle relative to the lower region, further comprising an articulating mount for holding a pneumatic needle scaler.

2. The apparatus of claim 1 wherein the pneumatic needle scaler is in fluid communication with an air compression source through the handle assembly.

3. The apparatus of claim 1 further comprising a gas pressure relief valve in fluid communication with the pneumatic needle scaler.

4. The apparatus of claim 1 further comprising a pneumatic controller adjacent the handle assembly.

* * * * *